US005300003A

United States Patent [19]

Hull

[11] Patent Number: 5,300,003

[45] Date of Patent: Apr. 5, 1994

[54] HANDLE DEVICE FOR EXERCISING EQUIPMENT

[76] Inventor: Martin P. Hull, 630 Olive St., Menlo Park, Calif. 94025

[21] Appl. No.: 15,148

[22] Filed: Feb. 9, 1993

[51] Int. Cl.[5] ..... A63B 21/00

[52] U.S. Cl. ..... 482/139; 482/99

[58] Field of Search ..... 482/93, 94, 98-103, 482/106, 105, 108, 121-130, 139, 908

[56] References Cited

U.S. PATENT DOCUMENTS

| | | | |
|---|---|---|---|
| 90,305 | 5/1869 | Reilly | 482/139 |
| 4,019,734 | 4/1977 | Lee et al. | 482/125 |
| 4,026,549 | 5/1977 | Gunn | 482/139 X |
| 4,231,569 | 11/1980 | Rae | 482/93 X |
| 4,351,526 | 9/1982 | Schwartz | 482/108 |
| 4,540,173 | 9/1985 | Hopkins, Jr. | 482/139 X |
| 4,684,122 | 8/1987 | Desmond et al. | 482/105 |
| 4,768,780 | 9/1988 | Hayes | 482/106 X |
| 4,949,957 | 8/1990 | Cucchiara | 482/102 X |

*Primary Examiner*—Robert Bahr
*Attorney, Agent, or Firm*—Douglas A. Chaikin

[57] ABSTRACT

Disclosed herein is an device for use with exercising equipment defining a handle device. The handle device includes a support cross member for the user's wrist and a handle member for the user's grip. The handle device has a pair of shoulders at either end of the support cross member. The shoulders are upraised from the support cross member have openings to accommodate a pair of threaded rods having knurled knobs attached thereto and positioned in one of the openings. The threaded rods screw into threaded openings in the handle member and the ends of the rods are affixed thereto. Along each of the rods and between the shoulder and the handle member is a locking member. Depending upon preference and physical dimension and which hand is being used, a user can use the combination of the threaded rods, knurled knobs and locking members to adjust the spaced apart distance of the handle and support cross members as well as the angle therebetween.

16 Claims, 3 Drawing Sheets

HANDLE DEVICE FOR EXERCISING EQUIPMENT

BACKGROUND OF THE INVENTION

1. Field of the Invention

This invention relates to exercising equipment and more particularly to a detachable handle which may be used on a variety of exercising devices.

2. Previous Art

During the past twenty-five years, exercising devices have become popular. Various types of exercising devices for strengthening and conditioning and toning muscles have become widely known. Such devices include those made by Nautilus and Universal and more recently Cybex and others which are designed to specifically condition and strengthen an isolated muscle or group of muscles, e.g. biceps and triceps.

It will be appreciated that a muscle group generally includes a number of muscles, namely a primarily muscle to be exercised and muscles surrounding the primary muscle, known as the secondary muscles. The primary muscle to be exercised is dependent upon the secondary muscle(s). The secondary muscle(s) will provide a limit to the primary muscles, if as is often true, it is the weaker muscles. The exercise will only be able to be done as forcefully as the weaker muscles can sustain. Consequently, the primary muscle may not be working as near its maximum as desired.

In order to stimulate growth in a muscle, the muscle must be exercised at a level approximating its maximum. The above analysis is among the strong motivating factors using the equipment described above.

Unfortunately, the isolation of the muscle does not strengthen the surrounding or secondary muscles. Additionally, such exercise devices to do not stimulate the balance and the coordination of the muscles which are necessary for proper athletic movement.

With particular attention to the arm, it will be appreciated more fully hereinafter that the primary limitation is the hand and especially the wrist . The hand, supported by the wrist joint, must hold an object prior to arm exercise.

In order to prevent injury or hyper extension of the wrist, which is easily overloaded, a device is needed which will reduce the force the primary muscles of the upper body, namely the pectoralis major, latissimus dorsi and the long head of the tricep, exerts upon the wrist while allowing the primary muscles to be exercised at a level close to their maximum.

Additionally, it will be noticed from even a casual observation that one's wrist is not parallel with the hand. In other words, one's right wrist is set at a different angle to the right hand than one's left wrist and hand. By drawing a line across the wrist and knuckles of each hand, it will be seen that the two lines are not parallel, nor are the angles for the left and right equal. Rather the angles are complementary for each hand.

Thus, in addition to having a handle device which is designed to protect both hands, it would be desirable to have such an device which could be separately configured for each hand, the left and the right.

SUMMARY OF THE INVENTION

It is an object of this invention to provide a handle device that can be used with a variety of different exercising equipment.

It is a further object of this invention to provide such a handle device that can be used for specific upper body exercises while providing comfort and safety to the wrist.

It is a further object of this invention to provide such a handle device that can be used for specific upper body exercises while providing comfort and safety to the wrist as well as being adapted specifically for the left or right hand.

In accordance with the above objects and those that will be mentioned and will become apparent below, the handle device in accordance with this invention, comprises:

elongated handle means for gripping having a longitudinal axis extending therethrough;

elongated support means having a generally flat surface for providing support and having a longitudinal axis extending therethrough and a longitudinal plane extending from the longitudinal axis across the flat surface, the handle means being spaced apart from the support means and the longitudinal axis of the support means being generally parallel to the longitudinal axis of support means; and adjustment means for adjustable connecting the support means to the handle, and for fixing the support means at the desired relationship to the handle means.

The handle device in accordance with this invention effectively shifts the center of force of the grip location to the wrist joint itself. This effectively reduces the lever arm between the grip location and the wrist joint to zero and eliminates a great deal of potential for injury and hyperextension through strenuous exercise of the upper body. And, significantly, the limitation of the weakness of the wrist joint on the level of force exerted by the upper body is eliminated.

In the preferred embodiment, the handle device in accordance with this invention includes a connection member which removably connects the handle device to a an exercising device.

In another preferred embodiment, the handle device in accordance with this invention with this invention includes the support means having the flat surface comprises the support surface and defines a cross-support member. The cross-support member has upstanding shoulders at either end. The adjustment means including two threaded rods having a longitudinal centerline defining a longitudinal axis extending the length of the rod. The shoulders having openings for each of the threaded rods. The openings accept each of the threaded rods so that the longitudinal axis of each of the threaded rods makes an angle $\alpha$ of between 2 and 15 degrees with the support means longitudinal plane.

This elevates the handle means above the longitudinal plane of the support means and provides for comfortable and natural operation of the wrist during operation of an exercise.

Both of the threaded rods includes locking members which operate independently. This allows the ends of the handle means to be positioned differently from the support means. At the discretion of the user, the handle device in accordance with this invention can be positioned to specifically accommodate either the right or left hand.

Additionally, the handle device in accordance with this invention includes two knurled knobs in an opening in each of the shoulders for independently adjusting the rods. After the desired adjustment, the adjustment is locked in place by the locking member.

An active wrist joint is still needed during exercise. Using the adjustment structure included in the device in accordance with this invention, the surface of the skin of the wrist remains perpendicular to the direction of movement of the exercise. It will be appreciated with those familiar with exercises involving the arm that since the arm is tethered at the shoulder, all such exercises will involve some degree of rotation. It will further be appreciated that the angle of the wrist during the exercise is constantly changing and adjustment must be made throughout the exercise. This is accomplished by first adjusting the handle device in accordance with this invention prior to exercise.

An additional advantage is that the handle device in accordance with this invention substantially reduces the fatigue of the forearm muscle and the wrist as a limitation to exercise while at the same time anchoring strength and coordination of the athletic movement.

It is an advantage of this invention to a provide a handle device which enables users to perform upper body exercises on a variety of different exercise equipment.

It is an additional advantage of this invention to provide a handle device which provides comfort to the wrist while protecting the wrist from unnecessary damage.

It is an additional advantage of this invention to provide a handle device which can be specifically adapted to either the right or left hand.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
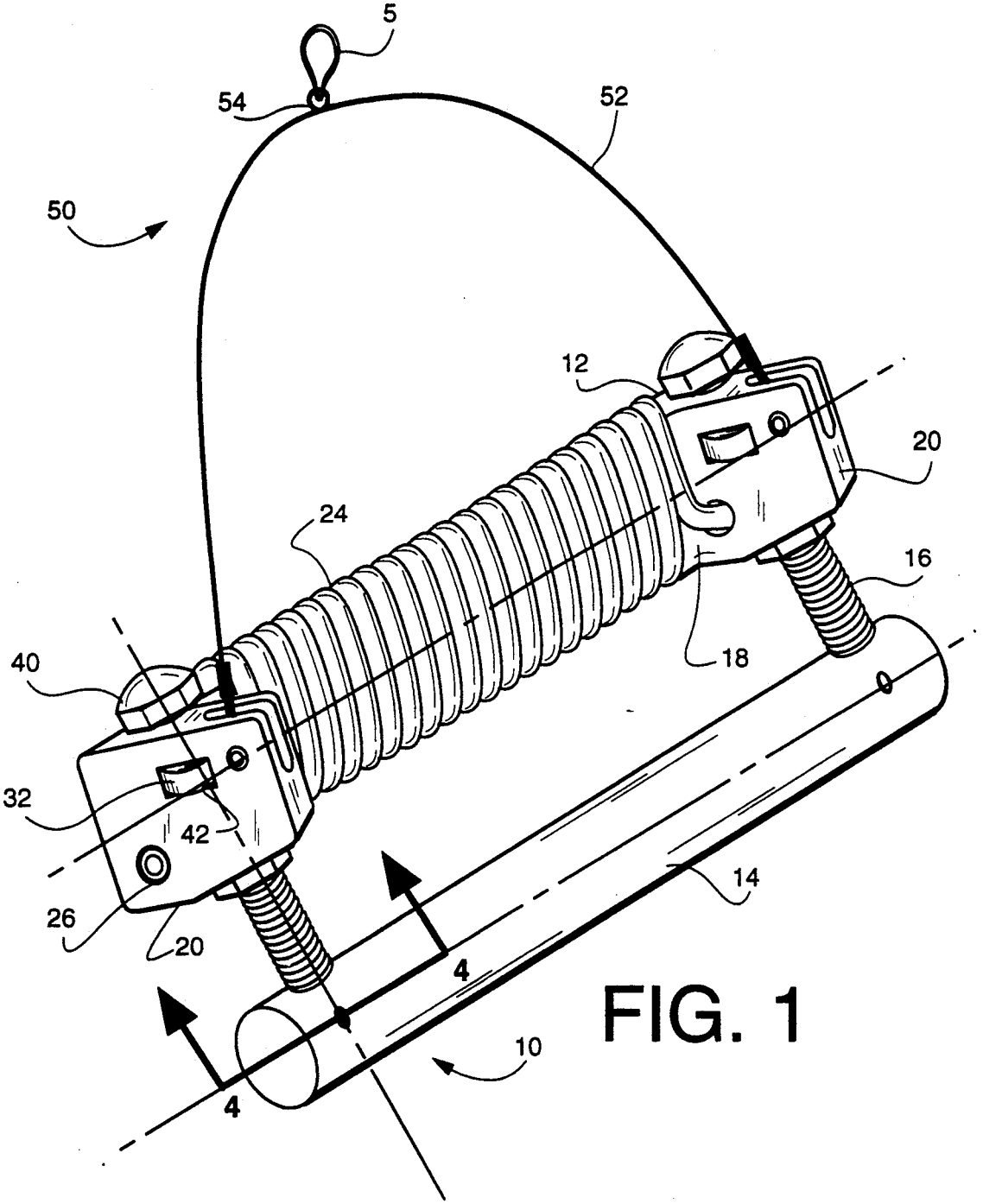
FIG. 1 is an elevated perspective plan view of the handle device in accordance with this invention.

The invention will now be described with respect to FIG. 1 which illustrates the handle device, generally denoted by the numeral 10. The handle device 10 includes a support member 12, a handle member 14 and a adjustment member 16.

Figure 3:
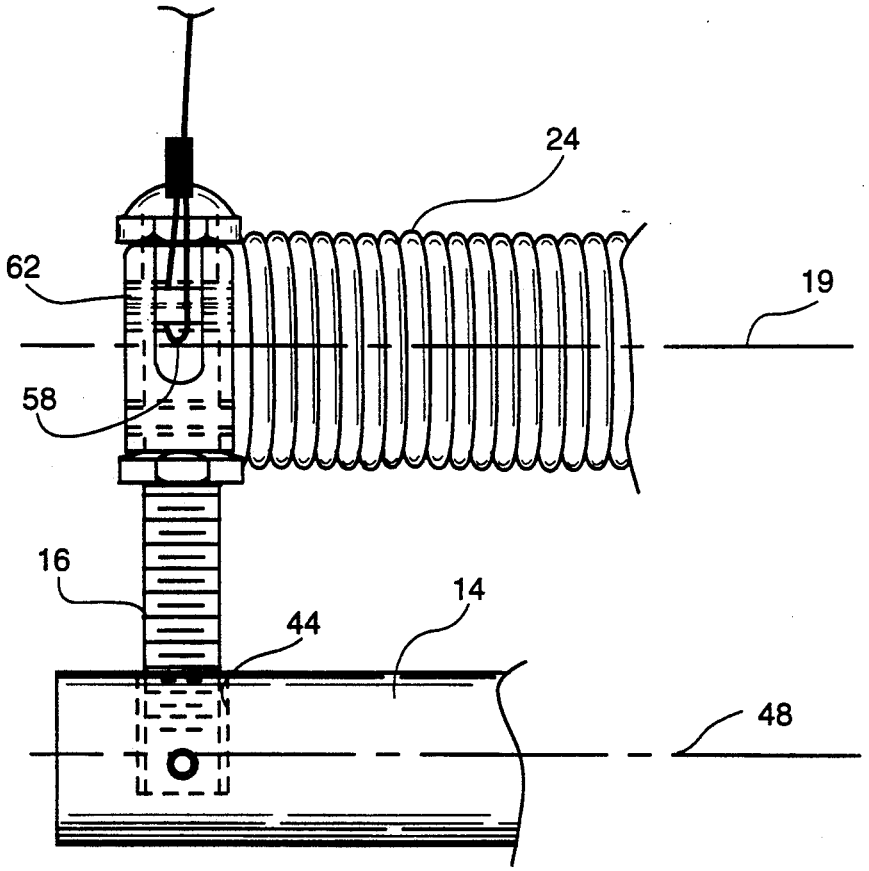
FIG. 3 is a top plan view of the handle device of FIG. 1.

The support member 12 supports the wrist of a user during an exercise as will be more fully appreciated hereinafter. The support member 12 has a cross-member 18. The support cross-member 18 is generally elongated and has flat top and bottom surfaces and a longitudinal centerline extending from one end of the support cross-member 18 to the other defining a longitudinal axis 19 (FIG. 3). A longitudinal plane 21 extends from the support member longitudinal axis 19 through the top surface.

The top and bottom surfaces are flat for accommodating the wrist of the user during exercise. The preferred support cross-member 18 in accordance with this invention is approximately 6" in length and approximately ⅜" thick.

Figure 2:
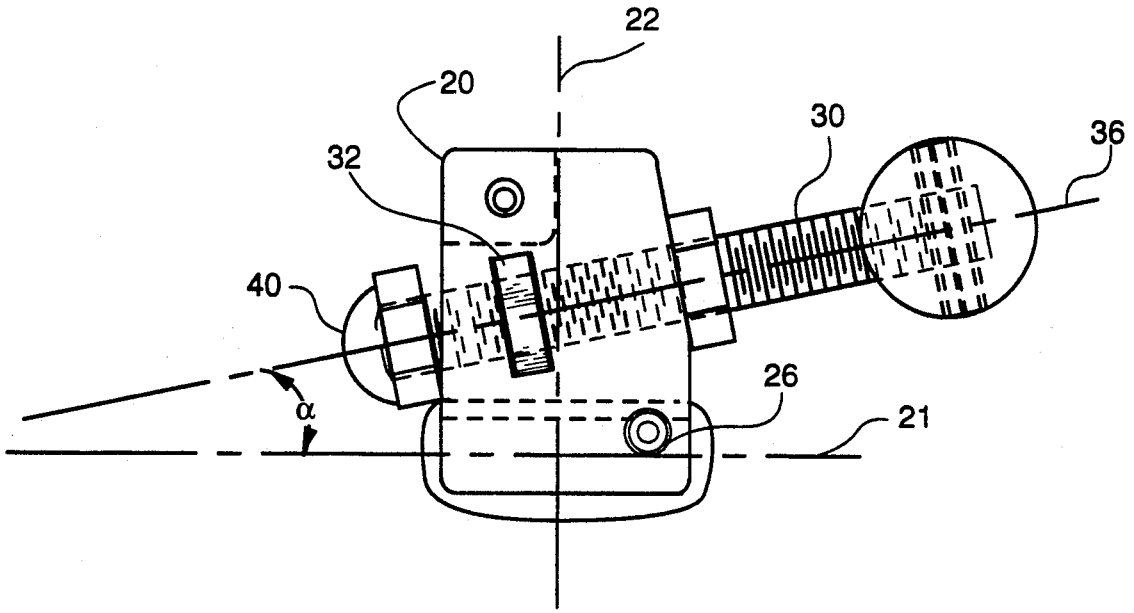
FIG. 2 is a side elevational view of the handle device of FIG. 1.

The support cross-member 18 has a pair of shoulders 20 at either end. The shoulders 20 are generally upright and extend from the top surface of the support cross-member 18. The shoulders 20 have a vertical centerline extending from the abutment of each of the shoulders 20 with support cross-member 18 to the top of each of the shoulders 20 defining a vertical axis 22 (FIG. 2). The vertical axis 22 is generally perpendicular to the support member longitudinal axis 19.

Each of the shoulders 20 has a plurality of openings as will be explained more fully with respect to the description of the adjustment member 16.

When the user's fingers grip the handle member 14, it will be appreciated that the user's wrist will be supported by the top surface of the support cross-member 18. In order to more comfortably support the user's wrist, the top surface is provided with a cushioning member 24.

In a preferred embodiment, the cushioning member 24 is made from surgical tubing. In some cases, the surgical tubing is black. The surgical tubing is wound flat around the top and bottom surfaces and then tied off in an opening 26 in each of the shoulders 20.

The adjustment member 16 is shown throughout FIGS. 1-5 and includes two threaded rods 30, a pair of knurled adjusting knobs 32, and a locking member 34. As best shown in FIG. 2, each of the threaded rods 30 has a longitudinal centerline defining a threaded rod longitudinal axis 36.

It will be appreciated that each of the shoulders 20 has a threaded opening 38 for accommodating each of the threaded rods 30. Each of the threaded rods 30 has a head 40, which acts as a stop for threading through each of the threaded openings 38.

As illustrated in FIG. 2, each of the threaded rod longitudinal axis 36 make an angle $\alpha$ with the support member longitudinal plane 21. Angle $\alpha$ is between 2 and 15 degrees. Angle $\alpha$ enables the user's wrist to be support in a naturally comfortable position. It has been observed that if angle $\alpha$ is too large, undue pressure will be created on the heel of each hand. If angle $\alpha$ is too small, undue pressure on the thumb joint is created.

Each of the knurled knobs 32 is positioned into a second opening 42 in each of the shoulders 20 as illustrated in FIGS. 1-3. By moving one of the knurled knobs 32 the handle member 14 is adjusted with respect to the support member 12 as will be explained and appreciated more fully hereinafter.

Figure 4:
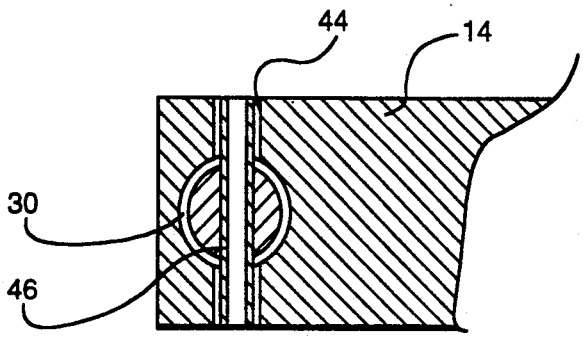
FIG. 4 is a sectional view of the handle device of FIG. 1, illustrating the attachment of the connecting rods to the handle member.
Figure 5:
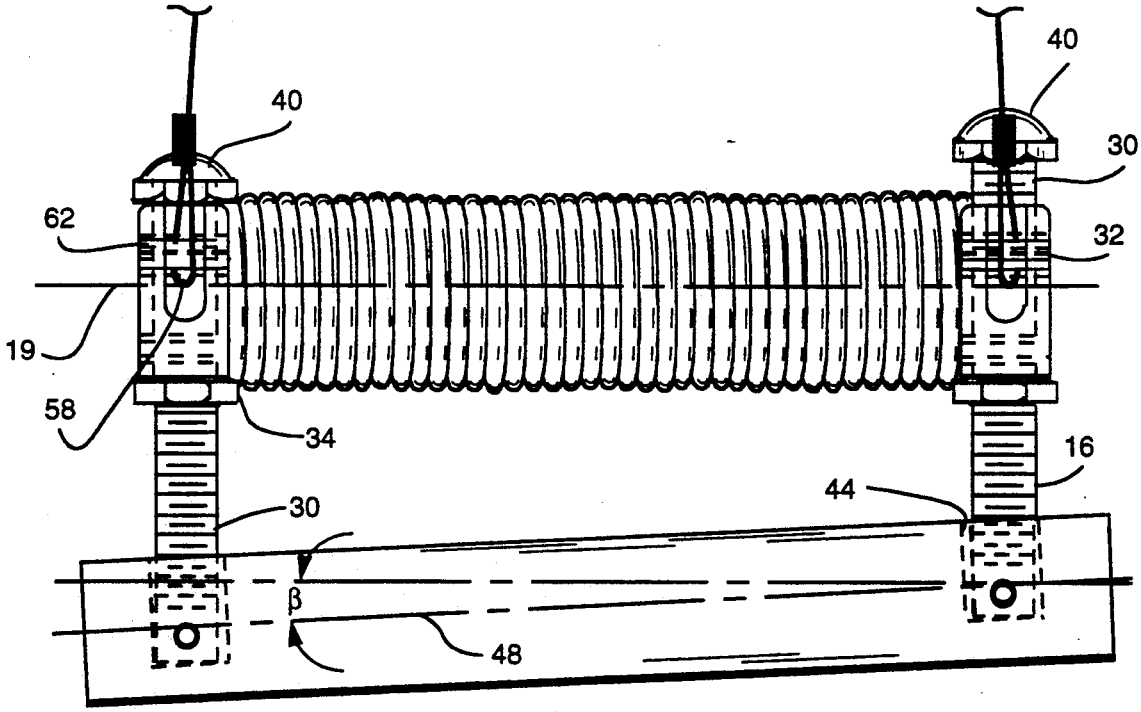
FIG. 5 is a top plan view of the handle device of FIG. 1 illustrating a left-handed use of the handle device.

Each of the threaded rods 30 is threaded into an opening 44 in the handle member 14 as best illustrated in FIGS. 3 and 5. The openings 44 may either be threaded to match the rods 30 or not. In either embodiment, one end of each of the threaded rods 30 is affixed to handle member 14 through the openings 44 and an opening in each of the threaded rods 30 as best illustrated in FIG. 4. A roll pin 46 is inserted in each of the openings 44 and through the opening in the end of each of the threaded rods 30 for affixing each of the threaded rods 30 to the handle member 14.

The roll pin 46 is made from spring steel and is normally outwardly extending similar to a compressed spring. The roll pin 46 is compressed in order to fit it within each of the openings 44 and the end of each of the threaded rods 30.

As shown with respect to FIGS. 3 and 5, the combination of the rods can be adjusted to determine the spaced apart distance between the support member 12 and the handle member 14.

The handle member 14 has a longitudinal centerline defining a handle member axis 48. FIGS. 3 and 5 will now be compared. In FIG. 3, the axis 19 and 48 are generally parallel, while in FIG. 5, the axis 19 and 48 are set off at an angle $\beta$. Angle $\beta$ is $\pm 15°$ in the preferred embodiment.

In the embodiment of the device 10 shown if FIG. 5, the device is adjusted for the left hand. It is seen that one end of the handle member 14 is closer to the support member 12 than the other end of the handle member 14. It will be appreciated that the adjustment member 16 could be operated for adaptation to the user's right hand. In that case, the other end of the handle member 14 is brought closer to the support member 12 after properly spacing apart the support member 12 and the handle member 14 using each of the knurled knobs 32.

The handle member 14 is generally cylindrical and designed for comfortable fit with the user's hand and more particularly, the handle member 14 is designed for comfortable gripping by the user's fingers. The handle member 14 may be made from a variety of materials including high strength plastics, such as engineering plastics or light weight metal such as aluminum.

As best illustrated in FIGS. 1, 3 and 5, the device 10 includes a connection member 50, denoted generally by the numeral 50. The connection member 50 connects the device 10 with the exercising equipment (not shown) as is generally known in the art. The connection member 50 includes a cable 52 having a loop 54 and a clip 56 through the loop 54.

The connection member 50 is connected to the exercising equipment by clipping the clip 56 to a compatible structure on the exercising equipment. The connection member 50 is attached to the handle device 10 at one of the openings in each of the shoulders 20.

As best illustrated in FIGS. 3 and 5, each end of the cable 52 has a second loop 58 and each of the shoulders 20 has an opening defining a pair of notches 60. A bar spans each of the notches 60 and each of the bars 62 is threaded through each of the second loops 58. The connection member 50, thus freely rotates about the axis created by the bars 62 and is therefore compatible with a wide variety of different exercise equipment.

While the foregoing detailed description has described several embodiments of the handle device for exercising equipment in accordance with this invention, it is to be understood that the above description is illustrative only and not limiting of the disclosed invention. Particularly, the angles $\alpha$ and $\beta$ may significantly change all within the spirit and scope of this invention. It will be appreciated that a variety of materials may used for the different parts within the scope and spirit of this invention. For example, the member may all be made from a lightweight metal such as aluminum or from a durable and rugged plastic such as engineering plastic. Thus, the invention is to be limited only by the claims as set forth below.

What is claimed is:

1. A device for exercising equipment, comprising:

elongated handles means for gripping by a user having a longitudinal axis extending therethrough;

elongated support means having a generally flat surface for providing support and having a longitudinal axis extending therethrough and a longitudinal plane extending from the longitudinal axis across the flat surface, the handle means being spaced apart from the support means and the longitudinal axis of the support means being generally parallel to the longitudinal axis of the support means and the support means having shoulders at either end; and adjustment means for adjustable connecting the support means to the handle, and for fixing the support means at the desired relationship to the handle means, the adjustment means including first and second adjustment means attached at one end of the shoulders of the support means and at the other end to the handle means, the first and second adjustment means, each includes a first and a second threaded rod member, respectively, each of the rod members are threaded into the shoulders and each of the shoulders has an opening, each of the first and second rod members has a knob threaded onto each of the rods and positioned in the opening of the shoulder for adjusting the spaced apart distance between the support means and the handle means and for adjusting the relative angle of each axis.

2. A device for exercising equipment as set forth in claim 1, wherein the adjustment means comprises first adjustment means to adjust the spacing between the support means and the handle means and second adjustment means for adjusting the relative angle between the longitudinal axis of the handle means and support means.

3. A device or exercising equipment as set forth in claim 1, wherein the handle means has spaced apart threaded openings compatible for accepting the threaded rods and wherein the other ends of the threaded rods are fixed within openings of the handle means.

4. A device for exercising equipment as set forth in claim 3, wherein the adjustment means includes locking means on each of the threaded rods and between the handle means and the support means.

5. A device for exercising equipment as set forth in claim 4, wherein the locking means comprises a nut threaded onto each of the threaded rods.

6. A device for exercising equipment as set forth in claim 5, wherein the means for affixing each of the threaded rods to the handle means comprises a roll pin through an opening in the handle means and through the other end of the threaded rods.

7. A device for exercising equipment as set forth in claim 1, wherein the device includes means for connection to the exercising equipment.

8. A device for exercising equipment as set forth in claim 7, wherein the means for connection is rotatably connected to the support means.

9. A device for exercising equipment as set forth in claim 8, wherein the support means has shoulders on either side and each shoulder has a slotted opening for rotatable connection with the means for connection.

10. A device for exercising equipment as set forth in claim 1, wherein the support means includes a cross member and wherein the cross member has means for cushioning.

11. A device for exercising equipment as set forth in claim 10, wherein the cushioning means is made from surgical tubing.

12. A device for exercising equipment as set forth in claim 10, wherein the cushioning means is made from black surgical tubing.

13. A device for exercising equipment as set forth in claim 1, wherein the support means, the handle means and the adjustment means are all made from plastic.

14. A device for exercising equipment as set forth in claim 1, wherein the support means, the handle means and the adjustment means are all made from lightweight metal.

15. A device for exercising equipment, comprising:

elongated handle means for gripping by a user having a longitudinal axis extending therethrough;

elongated support means having a flat surface for providing support and having a longitudinal axis extending therethrough, and a longitudinal plane extending from the longitudinal axis across the flat surface, the handle means being spaced apart from the support means and the longitudinal axis of the support means being generally parallel to the longitudinal axis of support means, the support means has shoulders at either end, and each of the shoulders has a centerline defining a vertical axis generally perpendicular to the support means longitudinal axis, and the support means having shoulders at either end; and adjustment means for adjustably connecting the support means to the handle, and for setting the support means at the proper relationship to the handle means, the adjustment means including first and second elongated adjustment members, each member having a longitudinal centerline defining a horizontal axis, the adjustment members horizontal axis making an angle of between 2 and 15 degrees with the longitudinal plane, the adjustment means includes first and second adjustment means attached to one end of the shoulders of the support means and at the other end to the handle means, the first and second adjustment means, each includes a first and a second threaded rod member, respectively, each of the rod members are threaded into the shoulders and each of the shoulders has an opening, each of the first and second rod members has a knob threaded onto each of the rods and positioned in the opening of the shoulder for adjusting the spaced apart distance between the support means and the handle means and for adjusting the relative angle of each axis.

16. A device for exercising equipment, comprising:

an elongated handle member for gripping by a user having a longitudinal axis extending therethrough;

an elongated support member having a flat surface for providing support and having a longitudinal axis extending therethrough, and a longitudinal plane extending from the longitudinal axis across the flat surface, the handle member being spaced apart from the support member and the longitudinal axis of the support member being generally parallel to the longitudinal axis of handle member, the support member has shoulders at either end, and each of the shoulders has a centerline defining a vertical axis generally perpendicular to the support means longitudinal axis, and the support means having shoulders at either end; and adjustment means for adjustably connecting the support means to the handle, and for setting the support means at the proper relationship to the handle means, the adjustment means including first and second elongated adjustment members, each member having a longitudinal centerline defining a horizontal axis, the adjustment members horizontal axis making an angle of between 3 and 14 degrees with the longitudinal plane, the adjustment means includes first and second adjustment means attached at one end of the shoulders of the support means and at the other end of the handle means, the first and second adjustment means, each includes a first and a second threaded rod member, respectively, each of the rod members are threaded into the shoulders and each of the shoulders has an opening, each of the first and second rod members has a knob threaded onto each of the rods and positioned in the opening of the shoulder for adjusting the spaced apart distance between the support means and the handle means and for adjusting the relative angle of each axis.

* * * * *